United States Patent [19]

Watanabe et al.

[11] 4,180,334

[45] Dec. 25, 1979

[54] DOT PRINTER

[75] Inventors: Akinori Watanabe; Katsumasa Shinozuka, both of Tokyo, Japan

[73] Assignee: Oki Electric Industry Co., Ltd., Tokyo, Japan

[21] Appl. No.: 924,172

[22] Filed: Jul. 13, 1978

Related U.S. Application Data

[63] Continuation of Ser. No. 773,832, Mar. 3, 1977, abandoned.

[30] Foreign Application Priority Data

Mar. 10, 1976 [JP] Japan ..... 51-24984

[51] Int. Cl.[2] ..... B41J 3/12

[52] U.S. Cl. ..... 400/124; 400/320

[58] Field of Search ..... 400/119, 120, 121, 124, 400/126, 320, 322, 328; 101/93.04, 93.05; 364/200 MS File, 900 MS File

[56] References Cited

U.S. PATENT DOCUMENTS

| | | | |
|---|---|---|---|
| 3,703,949 | 11/1972 | Howard et al. | 400/124 |
| 3,905,463 | 9/1975 | Boyce et al. | 400/124 |
| 3,925,787 | 12/1975 | Suzuki | 400/124 X |
| 3,942,619 | 3/1976 | Nordstrom et al. | 400/124 |
| 3,990,559 | 11/1976 | Martin et al. | 400/124 |
| 4,020,939 | 5/1977 | Quaif et al. | 400/124 |

*Primary Examiner*—Paul T. Sewell

*Attorney, Agent, or Firm*—Peter L. Berger

[57] ABSTRACT

The present invention discloses herewith a new and novel dot printer for printing characters or the like by a dot matrix, wherein print timing is automatically corrected in relationship to the spacing speed of printing elements so that uneven dot distance is eliminated.

9 Claims, 5 Drawing Figures

DOT PRINTER

This is a continuation of application Ser. No. 773,832 filed Mar. 3, 1977 now abandoned.

BACKGROUND OF THE INVENTION

As central processing units of electronic computers operate at increasingly higher speeds, it is required that terminal units of high speed printing apparatus also operates at higher speeds.

Heretofore high speed printers have been made by various means. This invention relates to a dot printer for printing characters or the like by means of a dot matrix. Typical printers using dot matrix for expressing characters of the like are, wire dot printer, thermal printer etc., and these are known. The spacing speed of these printers has a substantial effect on distance between any adjacent column of the dot matrix characters. This means when using the dot printer, any dot is printed on each column at a predetermined timing, and thus increased or decreased spacing speeds results in widened or narrowed column dot distances, causing the characters to be printed with uneven spacing from each other. Hence it is desirable that the printing elements perform spacing operations at a predetermined constant speed. It is difficult, however, to maintain the predetermined speed throughout the whole spacing operation because of the performance properties of the driving mechanism for the spacing operation, the mass of the printing head in which the printing elements are contained and so forth. Moreover in the case of high speed printing, the speed of the printing operation of the printing elements becomes less negligible, compared with that of the spacing. Accordingly it is required to adjust the print timing in relationship to the variation of the spacing speed.

BRIEF SUMMARY OF INVENTION

As the improved means of the above described drawbacks in the hitherto known dot printers, the present invention is concerned with a new dot printer which is adapted to restore previously corrective values corresponding to the spacing speed in a memory storage, read the corrective value out of said storage device on every supply of signal generated at every time the printing elements are displaced by the predetermined space distance, and process said corrective value and the time interval of said signal to prepare a print timing for the printing elements so that automatic correction is achieved.

OBJECT OF THE INVENTION

A major object of the present invention is to provide a dot printer which is capable of making automatic correction for any print timing relation to any variation of spacing speed of the printing elements.

DETAILED DESCRIPTION OF INVENTION

Figure 1:
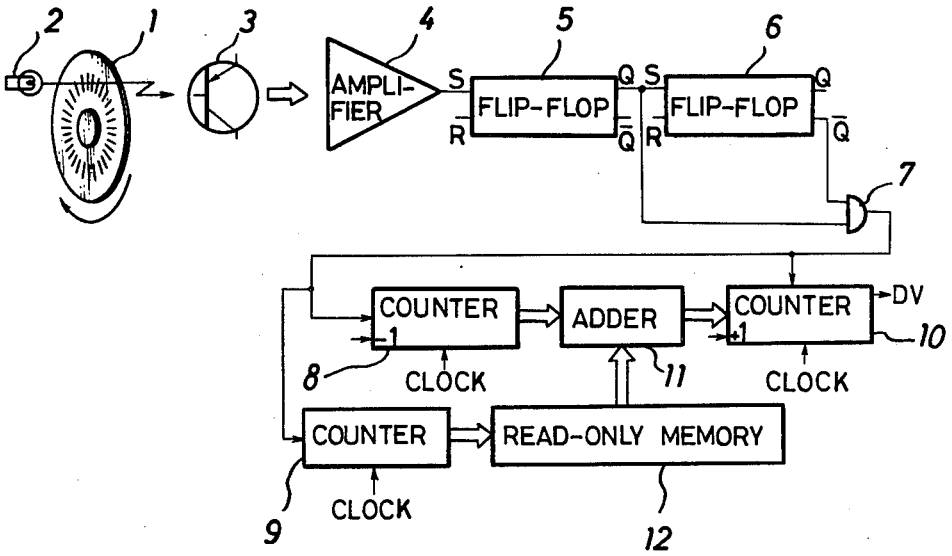
FIG. 1 is a block diagram of a circuit for controlling print operation.

The present invention will be easily understood in detail with reference to the accompanying drawings, in which FIG. 1 is a block diagram showing a circuit for controlling print operation of a dot printer according to the present invention. In FIG. 1 a slit disc (1) is provided in which a plurality of slits are provided adjacent to the periphery thereof. A light source (2) is arranged to allow a light beam therefrom to pass through the predetermined portion of said slit disc (1). A light detector (3) is provided for detecting the passing light which passed through said portion of the slit. An amplifier (4) is provided for amplifying and form-correcting the signal coming from said light detector (3). (5) and (6) are flip flop circuits, and a gate (7) is provided through which a differential signal is obtained out of the output signal of said amplifier (4). (8), (9) and (10) are commercially purchasable counters. A read-only memory (12) is adapted to store corrective information of the print timing in each address so that the address by counted value of said counter (9) has access thereto. An adder (11) is provided for adding the counted vlaue of said counter (8) to the information read out of said read-only memory (12).

Figure 4:
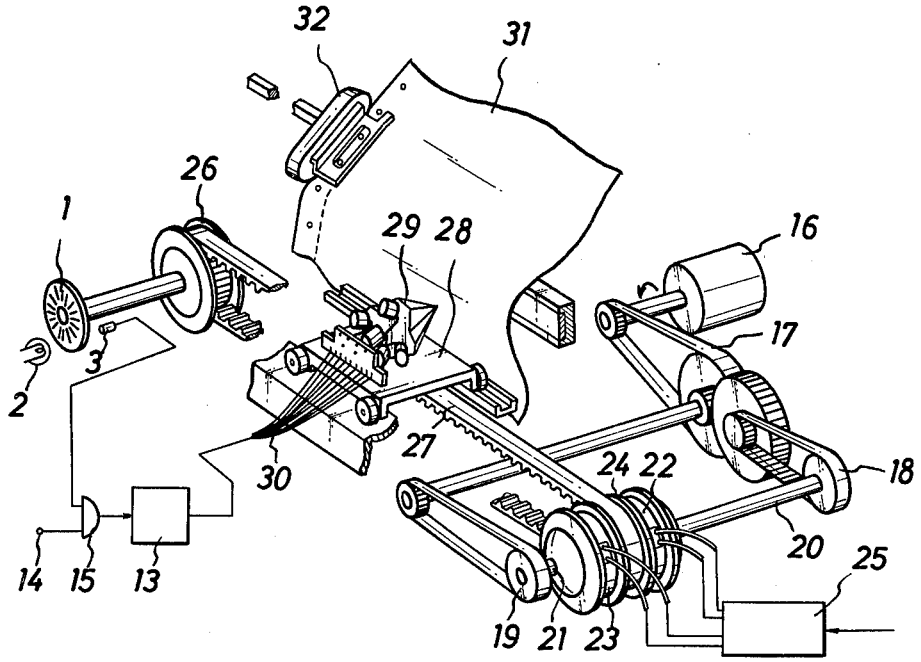
FIG. 4 illustrates the circuit for controlling the print operation of a dot printer involved in the present invention, which is installed on the dot printer to make the said circuit clearly understood.

Further to understand the circuit for controlling print operation of a dot printer involved in the present invention, the circuit for controlling the print operation installed on the dot printer is illustrated in FIG. 4 as block 13 which includes amplifier (4) flip flop circuits 5 and 6, and circuit 7, the commercially purchasable counters 8, 9 and 10, adder (11), circuit for controlling consisting of read-only memory, input terminal for printing data (14), the and circuit for according to timing output signal of the abovesaid circuit for controlling (13) with the printing signal to input into the input terminal (14). Driving motor (16) is provided for spacing which is continuously rotary. Gearbox 17 is connected with the said driving motor (16). (18) and (19) are transmission devices to transmit by means of respective shafts (20) and (21) the power coming from the abovesaid gearbox (17) to the next device. (22) and (23) are an electromagnetic clutch for spacing and an electromagnetic clutch for carriage return to optionally transmit to the driving pulley (24) the power transmitted from the abovesaid transmission devices (18) and (19) through the shafts (20) and (21). (25) is the cirucuit for controlling the carriage to drive the respective performance of the abovesaid electromagnetic clutch for spacing (22) and electromagnetic clutch for carriage return (23). (26) is the guide pulley fixed in a body at the shaft of the abovesaid slit disc (1). (27) is the endless belt equipped between the abovesaid driving pulley (24) and the guide pulley (26) and which fixes the carrier (28) between them. (29) is the printing head equipped with the dot wires for dot printing and a plurality of plunger magnets for driving such dot wire, which is installed on the abovesaid carrier (28). (30) is the input conductor to plunger magnets of the abovesaid printing head (29). (31) is recording paper, and (32) is the feeding mechanism to feed the abovesaid recording paper.

Figure 2:
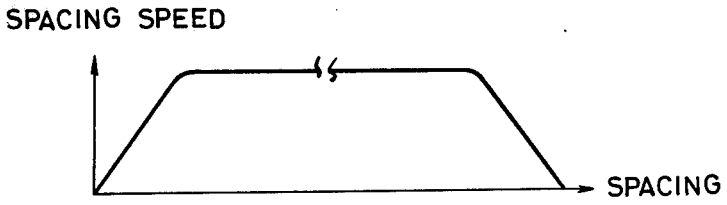
FIG. 2 is a characteristic curve illustrating the variation of the spacing speed during printing one line by means of the printing elements.

Due to such structure of the dot printer, when adding the electromagnetic clutch for spacing (22) to operate the spacing of carrier (28), the carrier (28) is continuously displaced instead of starting and stopping by one character by the width of recording paper (31), however the electromagnetic clutch for spacing (22) requires time to start. For such reason, endless belt (27), guide pulley (26), slit disc (1), carrier (28) and printing head (29) require a certain length of time after starting to reach the predetermined constant speed, as indicated in FIG. 2. Consequently, if the dot is printed by the printing head (29) during the abovesaid certain length of time after starting, it will result in a widened or narrowed column dot distance, as described above. For such reason, the present invention makes it possible to make automatic correction for any print timing by the circuit for controlling print operation as indicated in FIG. 1. The following is the explanation in the light of FIG. 1.

In the above arrangement the counter (8) resets the preceding counted signal on addition of the slit differential signal from the and gate (7), and at the same time sets the whole bit to 1 over again to assure countdown at every time as a clock pulse is added. Further the counter (10) is reset in the same way as said counter (8), when the slit differential signal is added thereto. At the same time, however, the processed result by the adder (11) is transferred so that count-up above the value of said result is established. The counter (9) performs count-up by 1 on each addition of the slit differential signal. In this connection it should be noted that each slit of the slit disc (1) is disposed with relation to the spacing speed of the printing elements and the column dot distance of the dot matrix characters, and that any slit signal is generated at every time when the printing elements perform spacing by the distance equivalent to one column dot distance at the predetermined constant speed.

The read-only memory 12 carries addresses equivalent to the number of dot column, each of which permits the information for correcting the print timing to be stored in the form of binary numeral so as to read the numeral starting from address 1 in order, corresponding to the counted number of the counter (9).

FIG. 2 illustrates the variation of the spacing speed of the printing elements during printing operation for one row. Since it was found out previously that the spacing speed varies in accordance with the curve in FIG. 2, said read-only memory 12 stores the corrective values corresponding to said speed variation.

Figure 3:
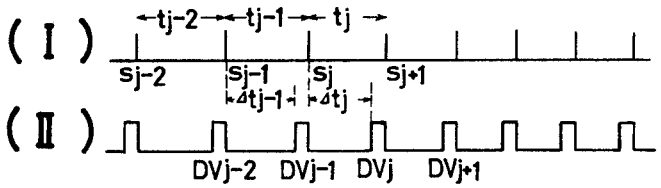
FIG. 3 is a time chart illustrating operational signals of each component in FIG. 1.

Now the printing operation of the dot printer according to the present invention will be described as follows;

As shown in FIG. 3(I), the time interval of generation of the slit differential signals becomes gradually shorter, until the spacing speed reaches the steady speed through a low speed range. Now consider the case that slit differential signal Sj-1 is input to the counter (8), (9) and (10). Then the counter (8) is reset at the same time as the counted value which is counted down during the time length Tj-1 between slit differential signals Sj-2 and Sj-1 is transferred to the adder (11), while the counter (9) performs count-up to be j-1, and comes to read the corrective value by making access to address j-1 of the read-only memory (12). The read corrective value is fed to the adder 11 to be added to the counted value of said counter (8), and the result of processing in this way is transferred to the counter (10). Said counter (10) is adapted to get ready for starting to count, at the same time as it is previously reset by means of said slit differential signal Sj-1. Once the output of the adder (11) is set, counting operation starts from the set value, and as it performs count-up till the whole bit becomes 1, driving for printing element DVj-1 is issued as shown in FIG. 3 (II). Next, as slit differential signal Sj is issued, the same operation as described above is repeated again. As a result the counted number of the counter (8) is transferred to the adder (11), and at the same time the counter (9) performs count-up by 1 so that the corrective count of the next address is read through the read-only memory (12) and transferred to the adder 11 to be added, and the result of processing in this way is set in the counter (10). Thus as the counter (10) performs count-up again until the whole bit becomes 1, the driving signal for printing element Dvj is issued.

Since the dot printer of the present invention is provided with the print control cirucit which operates in the above described manner, in case the spacing speed is increased in such a manner that the time interval between any two slit signals is reduced, for instance, from tj-1 to tj, the result of addition gets larger than that of the preceding operation because the corrective count that is read through the read-only memory (12) is a larger value than the prior corrective count because the clock is feeding counter 9 for the shorter time periods. As a result the time length through which the whole bit of the counter (10) performs count-up to 1 is shortened, and the time length $\Delta tj$ through which the driving signal for printing element DVj is issued becomes shorter than time length $\Delta tj-1$ through which the preceding driving signal for printing element DVj-1 is issued. This is because print timing of the printing elements becomes faster, as the spacing speed is increased. Since variation of the spacing speed can be estimated previously and corrective value corresponding to the spacing speed can be read by way of counting operation which is performed for the slit signal by the counter (9), it is possible to correct the print timing of the printing elements in response to the variation of the spacing speed in the most close manner only by storing the optimum corrective value in each address of the read-only memory (12).

Figure 5:
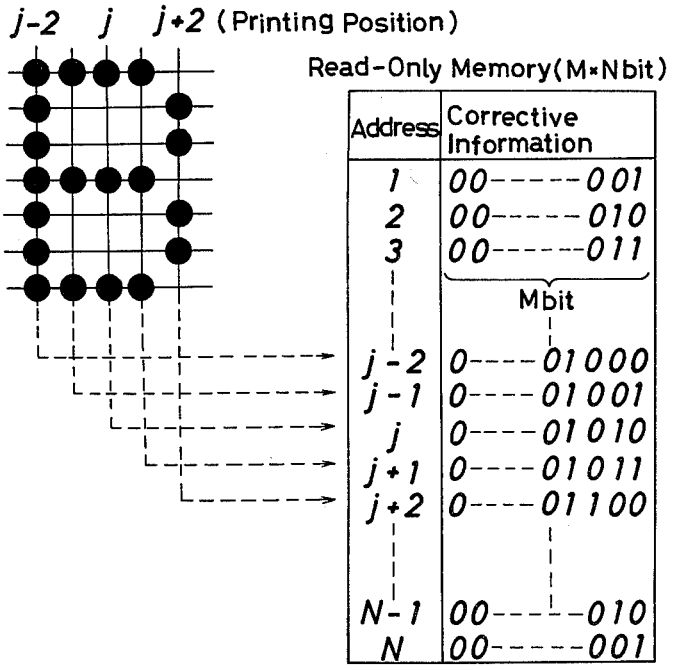
FIG. 5 illustrates the relation of an example for the corrective value as previously stored in the read-only-memory with the memory location corresponding to the printing position.

FIG. 5 illustrates the relation of an example for the corrective value as previously stored in read-only memory (12) with the memory location corresponding to the printing position. Assuming that maximum number of dot printing rows during a printing operation for one row should be N, the total number of addresses carried by read-only memory would be N. Each address of 1−N respectively corresponds to the dot printing column of 1−N, and the numeral is read starting from address 1 in order every time when the slit signal is issued. The slit signal is generated at time interval required for the displacement of printing element for dot row distance, and it is counted by the counter (9).

To explain how it is read out of read-only memory in case of printing the abovesaid character "B" between the rows (j−2)−(j+2), first of all, the counter (9) performs count-up by slit differential signal Sj−2, and the value becomes (j−2) and the corrective value (0. . . 01000) of address (j−2) is read out of the read-only memory. The abovesaid corrective value is transferred to the adder (11), to be added to the count value of the counter 8 when slit differential signal Sj−2 was issued. The processed result is set to the counter (10), and the highest carry signal of this counter (10) is shifted as the printing element driving signal DVj−2, to perform the printing character of (j−2) address. Then, as the slit differential signal Sj−1 is issued, the counter (9) performs count-up to (j−1), and the corrective value (0 . . . 01001) of (j−1) address is read through the read-only memory, and added to the count value of counter (8) when the abovesaid slit differential signal Sj−1 was issued. The abovesaid processed result is loaded to the counter (10) in the same manner as stated above, and the printing element driving signal DVj−1 is shifted to perform the printing character of (j−1) address. Hereafter, in the same manner, the printing character of j−(j+2) address are performed.

If the abovesaid performance of printing character is carried out while the spacing time decreases, the time interval of slit differential signal gradually becomes smaller in the form of tj−2>tj−1>tj, as indicated in FIG. 3. Consequently, the timing for shifting the driving signal DV of printing element should naturally be quickened. The moving time of printing element itself, for instance, the time required for the dot printing wire to move from stationary state to reach the printing medium should also be considered in case of speedy spacing operation. Even if it is a short length for time of the abovesaid movement, when the spacing is operated at high speed, the moving direction and displacement of printing element is too large to be neglected, resulting in the expanded distance between any adjacent columns.

As regards to above-described printing character system involved in the present invention, since variation of the spacing speed can be estimated previously, you only have to decide the corrective value of read-only memory (12) correspondingly. For instance, the corrective value of (j−2) −(j+2) addresses becomes larger by 1 in order. It means that the timing for shifting the printing element driving signal DV would be quickened in order by 1 clock periodic time, so that, as shown in FIG. 3, the time from the generation of slit signal to the issue of printing element driving signal DV, becomes gradually shorter in the form of Δtj1>Δtj.

As above described, the present invention lies in that on the assumption that it can be previously estimated how the spacing speed of the printing elements does vary, print timing is prepared by storing corrective value corresponding to variation of the spacing speed in a suitable memory storage e.g. read-only memory or the like, making access to each address from address 1 in order at every time when print timing preparation signal is generated, as the printing elements start to perform the spacing, and processing the read corrective value and the time count value between said print timing preparation signals. Thus the dot printer according to the present invention has an useful advantage that print timing can be automatically corrected by following exactly the variation of the spacing speed of the printing elements so as to maintain a constant pitch between every two dot columns of the dot matrix characters, resulting in substantial improvement of printing quality.

It will be obvious for any expert of the art that the present invention is not limited only to the above embodiment thereof, but any change or modification may be undertaken without departing from the spirit of the invention. For instance, by setting the corrective count that is read through the read-only memory (12), to less value of the corrective count than that previous to the corrective count of one address, print timing may be issued when the counter (8) performs count-up operation, while the counter (10) performs count-down operation, so that the whole bit of the counter (10) becomes 0. Although a slit disc is employed in the shown embodiment, various type of timing generator may be of course put in use.

What is claimed is:

1. For a dot matrix type printer comprising a print head with print elements for accomplishing print functions by depositing dots in columns selectively as the print head moves across a paper on which printing is effected, an improvement comprising a control system for controlling the timing for said print elements to deposit successive columns of ink dots, said control system comprising means to measure the time of travel of said print elements between successive columns of dots to form a measured time, means to store predetermined corrective time amounts corresponding to respective columns of ink dots, means to combine said measured time and a respective one of said corrective amounts for controlling the time of activation of said print elements.

2. An apparatus as claimed in claim 1, wherein said means to combine said measured time and said corrective amounts comprises adder means.

3. An apparatus as claimed in claim 2, further comprising timing signal generator means for generating a timing signal each time that a column of dots is deposited on said paper.

4. An apparatus as claimed in claim 3, wherein said timing signal generator means comprises a slit disk rotatable with the movement of said print head, said slit disk being provided with spaced apart radial slits through which light can pass, said slits providing timing signals for said timing signal generator means corresponding to the spacing between successive dot columns and the time of movement of said print head between said successive dot columns.

5. An apparatus as claimed in claim 1, wherein said means to combine comprises an adder, said means to store comprises an addressable memory with the contents of the locations in memory containing respective different corrective time amounts stored in binary form, said means to measure said time of travel comprising a binary counter, said adder adding the contents of said binary counter to said corrective time amount.

6. An apparatus as claimed in claim 5, further comprising clock pulse means connected to said binary counter, said clock pulse means causing said counter to count during the time between the printing of successive dot columns.

7. An apparatus as claimed in claim 5, wherein said addressable memory comprises a read only-memory.

8. An apparatus as claimed in claim 1, wherein said means to store comprises an addressable memory with the contents of the locations in memory containing respective different corrective time amounts, and means to address said memory comprising counter means.

9. An apparatus as claimed in claim 8, wherein said counter means of said means to address said memory is incremented by one for each dot column location as said print head moves across the paper.

* * * * *